US005301410A

United States Patent [19]

Finzer

[11] Patent Number: 5,301,410

[45] Date of Patent: Apr. 12, 1994

[54] WORKPIECE MACHINING CENTER OF MODULAR CONSTRUCTION AND DRIVE MODULE FOR SAME

[76] Inventor: Heinz Finzer, Rheinvogtstrasse 17, 7880 Bad Saeckingen 11, Fed. Rep. of Germany

[21] Appl. No.: 907,782

[22] Filed: Jul. 1, 1992

Related U.S. Application Data

[63] Continuation of Ser. No. 661,490, Feb. 26, 1991, abandoned, and a continuation of Ser. No. 768,294, Oct. 7, 1991, Pat. No. 5,209,101.

[30] Foreign Application Priority Data

Feb. 5, 1990 [DE] Fed. Rep. of Germany ..... 4003396
Mar. 29, 1990 [DE] Fed. Rep. of Germany ..... 4010115
Aug. 29, 1990 [DE] Fed. Rep. of Germany ..... 9012379

[51] Int. Cl.[5] ..... B21J 13/00

[52] U.S. Cl. ..... 29/335; 29/33 Q; 72/405; 72/446; 483/28

[58] Field of Search ..... 29/33 Q, 33 S, 564.1, 29/564.2, 771, 786, 788, 793, 796; 72/404, 442, 446, 449; 483/28, 29

[56] References Cited

U.S. PATENT DOCUMENTS 4,457,160 7/1984 Wünsch ..... 72/446
4,502,314 3/1985 Wünsch ..... 72/449 X
4,528,903 7/1985 Lerch ..... 72/446 X
4,581,917 4/1986 Moriyama et al. ..... 72/446
4,607,517 8/1986 Finzer et al. ..... 72/449
4,773,250 9/1988 Miyazaki ..... 72/405

FOREIGN PATENT DOCUMENTS 0119599 7/1988 European Pat. Off. .
2737442 1/1980 Fed. Rep. of Germany .
3234981 6/1986 Fed. Rep. of Germany .

OTHER PUBLICATIONS

"Modulare Hochleistungs-Stanzbiegeautomaten für die just-in-time Fertigung"-Draht und Band-Stanzen und Biegen.

International Search Report regarding PCT/EP90/02310 and English translation.

International Search Report regarding PCT/EP90/02320 and English translation.

*Primary Examiner*—Z. R. Bilinsky

*Attorney, Agent, or Firm*—McAulay Fisher Nissen Goldberg & Kiel

[57] ABSTRACT

Described herein is a drive unit for a machining center of modular construction comprising different work modules with tools which are positively controlled with respect to time, e.g. bending tools, front-feed devices, welding stations, assembly units or the like. The drive unit is constructed as a press which comprises the main drive for the machining center. The drive of adjacent work modules is effected via meshing toothed wheels which bridge the interface planes between the work modules, so that the drive unit can be integrated into the machining center in a space-saving and economical manner.

33 Claims, 14 Drawing Sheets

WORKPIECE MACHINING CENTER OF MODULAR CONSTRUCTION AND DRIVE MODULE FOR SAME

This application is a continuation of application number 07/661,490, filed Feb. 26, 1991, and appln. no. 07/768,294 filed Oct. 7, 1991.

The invention is directed to a modular machining center comprising various work modules, each of which comprises tools which are positively controlled with respect to time, e.g. punching/bending tools, front-feed devices, welding stations, assembly units and the like according to the preamble of claim 1, as well as to a drive module for same.

Such centers are known and are distinguished particularly by fact that the work modules can be used for multiple functions in extremely economical possibilities of Conventionally, the core element of such machining centers is a punching/bending tool unit which comprises a main drive in a base, which main drive drives a drive gear which is supported above it in a separate housing; the drive gear drives a plurality of work units such as bending carriages or slides, cutting punches, welding electrodes etc. in a predetermined sequence with respect to time. The drive of other adjoining work units, e.g. (semi-finished product) front-feed devices or presses, is derived from this main drive, for which purpose, as a rule, more or less bulky drive means are required in the area of the interfaces between the work units. Therefore, it was attempted to accommodate a portion of these drive means in an enlarged base, so that possibilities for a modular combination of a plurality of work modules were greatly limited.

Such conventional concepts are known e.g. from US-PS 44 57 160 and from the documents Ep 0 119 599 B1 and DE-AS 27 37 442. In all of the known cases, the possibilities for converting the machining center are limited to the exchange of a housing resting on a relatively broad base; relatively costly manipulating devices are required for this purpose which, moreover, require time-consuming manipulation. Thus, the conversion of the machining center according to EP 0 119 599 requires a separate transport car having a highly loadable swivel axle, wherein separate means are required for bringing the unit housing to be exchanged into a plane in which it can be coupled to the base. In the machining center according to DE-AS 27 37 442, the exchangeability of the bending units likewise requires an elongated substructure, wherein the plug-in shaft connection more or less greatly limits the possibilities of exchanging the work units. An uncoupling of the modules is only possible by means of lateral movement.

Moreover, it has been shown that the main drive frequently reaches the limits of its capacity when all possible coupling points of the module are used up.

As a result of these conventional difficulties in the modular construction and conversion of machining centers, the central drive rim of a classical punch/bending tool unit has begun to be replaced (see DE-PS 32 34 981) by horizontal drive shafts and the work modules are connected linearly one after the other, wherein a separate main drive block is provided from which all drive movements are derived. However, the substantial advantage of the central drive rim, which consists in the freely movable arrangement of the bending tool units accompanied by a uniform distribution of power, is forfeited with this concept. Another disadvantage of this concept consists in that conversion steps take up a relatively great amount of time and a relatively great amount of construction space is required for the main drive block, especially since the latter generally has large dimensions so that as many modules as possible can be connected in tandem.

Therefore, the present invention has the object of providing a machining center of modular construction having different work modules driven by a drive unit, in which the drive can be integrated into the machining center in a space-saving and economical manner and the possibility is provided of exchanging work modules quickly and safely without having to move the modules laterally. Another object consists in providing a multifunctional drive unit which can be adapted to the respective predetermined construction of the machining unit in an optimal manner.

This object is met by means of the features indicated in the characterizing part of claim 1 and by means of a drive module according to claim 28.

According to the invention, the main drive of the machining center is constructed as a base module which can be manipulated separately. This has the advantage, on the one hand, that the maximum output of the drive is present in each instance at that location of the machining center where the greatest reserve power is required. In the course of this construction, according to the invention, additional work modules no longer require a separate drive, so that the base of these work modules can be constructed not only in a simpler manner, but with a unit modular dimension corresponding to the base module. As a result of the unit modular dimension, the base can also be utilized, for the first time, for purposes of support and transport, so that the exchange of the work modules is greatly simplified and the time required for it is shortened. For example, the base can be grasped and handled, together with the module housing resting on it, by means of a fork lift, wherein the cut out portions at the base contribute to a favorable distribution of weight. As a result of the complete exchange of the base, it is also no longer necessary to take special steps to bring the work module into the correct work plane. The latter is already fixed when the base is placed as a result of the unit modular dimension.

The direct transmission of power, via meshing toothed wheels, to work modules which are to be coupled still allows the work modules to be constructed with a central drive rim and its advantages to be fully utilized. The transmission of the drive movement from the press to the adjoining modules on the one hand and possibly between the individual work modules on the other hand via meshing toothed wheels enables a maximum of flexibility in the composition and conversion of the machining center, wherein it is particularly important that each work module can be exchanged separately without having to handle or move the other modules for this purpose. Accordingly, as distinct from the prior art, it is no longer necessary, when converting the machining center, to undo the combination of individual components in order to reach the individual unit to be exchanged. The sequence of the tandem arrangement of the different work modules also no longer has an effect on the time required for converting the machining center to the extent that it did previously because any desired work module can take the place of the work module to be exchanged as a result of the unit modular dimension of the base by moving away and removing the modules separately from the other modules.

The transmission of power by means of toothed wheels which mesh with one another provides the advantage that the individual work modules can be removed not only in two directions, i.e. to the front and to the rear, but also in the lateral direction in the case of work modules at the edge, so that the greatest possible flexibility is provided with respect to the handling of the work modules when assembling the machining center. In this way, the construction of the drive unit, according to the invention, allows the possibility of placing a completely equipped, new work module on the base from one side and e.g. simultaneously moving away the module to be exchanged toward the other side, so that more possibilities are provided with respect to automation of the exchanging process. This exchange of the machining modules is likewise possible when entire machining cells, i.e. work modules consisting of base and superstructure, are to be exchanged. In this way, retooling is effected in the manner of a palette exchange system, so that the shortest possible conversion and stoppage times result.

Accordingly, with the construction of the machining center, according to the invention, the combination of the drive/base module and the machining module resting on top of the latter results in a individual drive module which can serve as a central drive unit for a machining center. In many constructions, it can be advantageous to couple the drive/base module with a combined punching/bending tool unit in case this unit should require the greatest moment in the overall composite action.

In machining centers of the type described in the beginning, the press is generally the machining station with the highest energy requirement. Accordingly, in the further development according to claim 2, the drive unit is constructed as a press which forms the main drive for the entire machining center. This results in the additional advantage that the driven toothed wheel of the press can be stopped in an exactly defined rotating position at very low cost in this configuration, so that the coupling of the adjacent work module, which is to be operated synchronously with the press, is greatly simplified. This is because the press has exactly defined top and bottom dead-center positions of the press punch which can be made use of for positioning the driven wheel. The adjacent work modules are advantageously equipped with stopping devices by means of which the zero position of the tools relative to one another, which is present when decoupling, can be maintained at the respective work modules also during transport.

The development according to claim 3 enables a more flexible integration of the main drive in the machining center, thereby simultaneously enhancing the functioning of the press.

A particularly simple movement pattern for coupling and uncoupling the work modules results from the further development in claim 8. For this purpose, it is only necessary to disengage locking devices in the opposite sides of the housing parts and to move the work module to be exchanged, e.g. vertically relative to the plane of the central drive rim in the horizontal direction and parallel to the center axis of the central drive rim by means of the transporting means, e.g. the fork lift.

The bases of the work modules preferably have the same height as the base module which can be manipulated separately. The further development in claim 5 ensures via the simplest means that the cutting plane of a press housing resting on the base module is exactly aligned with the feed-in plane of the adjacent work module even after a possible repeated regrinding of the counter-cutting plate.

As was already mentioned in the preceding, the construction of the machining center, according to the invention, provides a maximum of flexibility in the combination of the components and the simultaneous advantage of the arrangement of the drive at the optimum location in the machining center in each instance. In this way, the work modules arranged next to the main drive module can be constructed in a simpler manner with respect to construction technology, e.g. with an empty base, wherein the additional advantage is provided that the construction space which is accordingly gained can be made use of for accommodating additional control units.

The division, according to the invention, between the base module, which can be manipulated separately, and the machining module demands a novel conception of the interface between these two areas. An advantageous construction of this interface is the subject matter of claim 9. The machining module is supported at the base or base module, respectively, over a large surface area via the intermediate plate, resulting in increased stability. Moreover, the intermediate plate can be utilized as a centering, transporting and fastening element, wherein the enlarged standing surface allows a pairing of surfaces between the machining module and the base module which closes in an undetectable manner even when the components are exchanged frequently.

Further, an adaptation to the respective drive version existing in the machining module, e.g. central wheel version or linear version, can be effected via the intermediate plate.

The concept, according to the invention, makes it possible to remove either individual machining modules or the base module receiving the main drive or a work module comprising base and superstructure from either side, as desired. In the latter case, it is advantageous to construct the base of the individual work modules so as to be slightly narrower than the machining modules resting on top of it, which is the subject matter of claim 10.

In order to make full use of the advantages provided by the novel construction of the machining center with respect to the flexibility in composition, it is advantageous to work with quick-change devices according to claims 16 ff. and 22 ff., respectively. However, it is also possible to construct the work modules so as to be self-drivable in their entirety, wherein it is advantageous in this case to assign a leveling function to the rollers simultaneously, according to claim 14.

The possibilities of use in production can be additionally expanded if quick-change devices are used for exchanging the individual modules. Since the modular machining center is accessible from both sides, quick-change devices can be arranged at the machining center from both sides and preferably put into operation simultaneously. With one quick-change device, a machining module which is already completely set up or a complete work module comprising base and machining module placed on the latter, respectively, can then be incorporated in the machining center at the same time that the module to be exchanged is moved away. There is accordingly a minimum of dead-times in production, wherein it is an additional advantage that the quick-change devices for both sides of the machining center are identically constructed and can therefore not only be more easily handled, but also used more economically.

A quick-change device which is very easy to handle and very light and has a long service life, particularly also in rough workshop operation, is provided with the further development according to claim 17.

The height of the rails can be aligned via simple means—advantageously with the features of claim 18—so that even the heaviest work modules can be transported over wide distances without difficulty, even when the floor is relatively sharply undulating.

The vertically adjustable arrangement of running rollers at the base serves to further simplify the removal of the individual modules. With this construction according to claim 19, the respective rail arrangement can easily be positioned under the respective lowerable rollers of the module to be exchanged. The transport rollers come into contact with the rail arrangement by means of the moving out of the supporting rollers, which can be reinforced, e.g. by means of a hydraulic servo-drive, so that a displacement of the module transversely relative to the work plane of the machining center is enabled without difficulty.

Advantageous developments of a quick-change device for exchanging the individual machining modules are the subject mater of claims 22 to 27. In the development according to claim 23, it is preferable that the cantilevering end portion of the guide rails, which are arranged so as to be parallel to one another, be supported on the upper side of the base when exchanging. The guide area of the base plate is preferably formed by a step which is set back by an amount corresponding to the vertical height of the cantilevering end of the rail, so that the guide rails are simultaneously assigned the function of laterally stabilizing the machining module.

The further development of claims 25 ff. provides the advantage that the module to be exchanged is movable in the direction of the guide rails so as to be suspended, as it were, on the base after the fastening screws are loosened under the influence of the supporting spring arrangement, so that manipulations are substantially simplified when exchanging and time can be saved in addition.

A number of embodiment examples of the invention are explained in more detail in the following with reference to schematic drawings.

Figure 1:
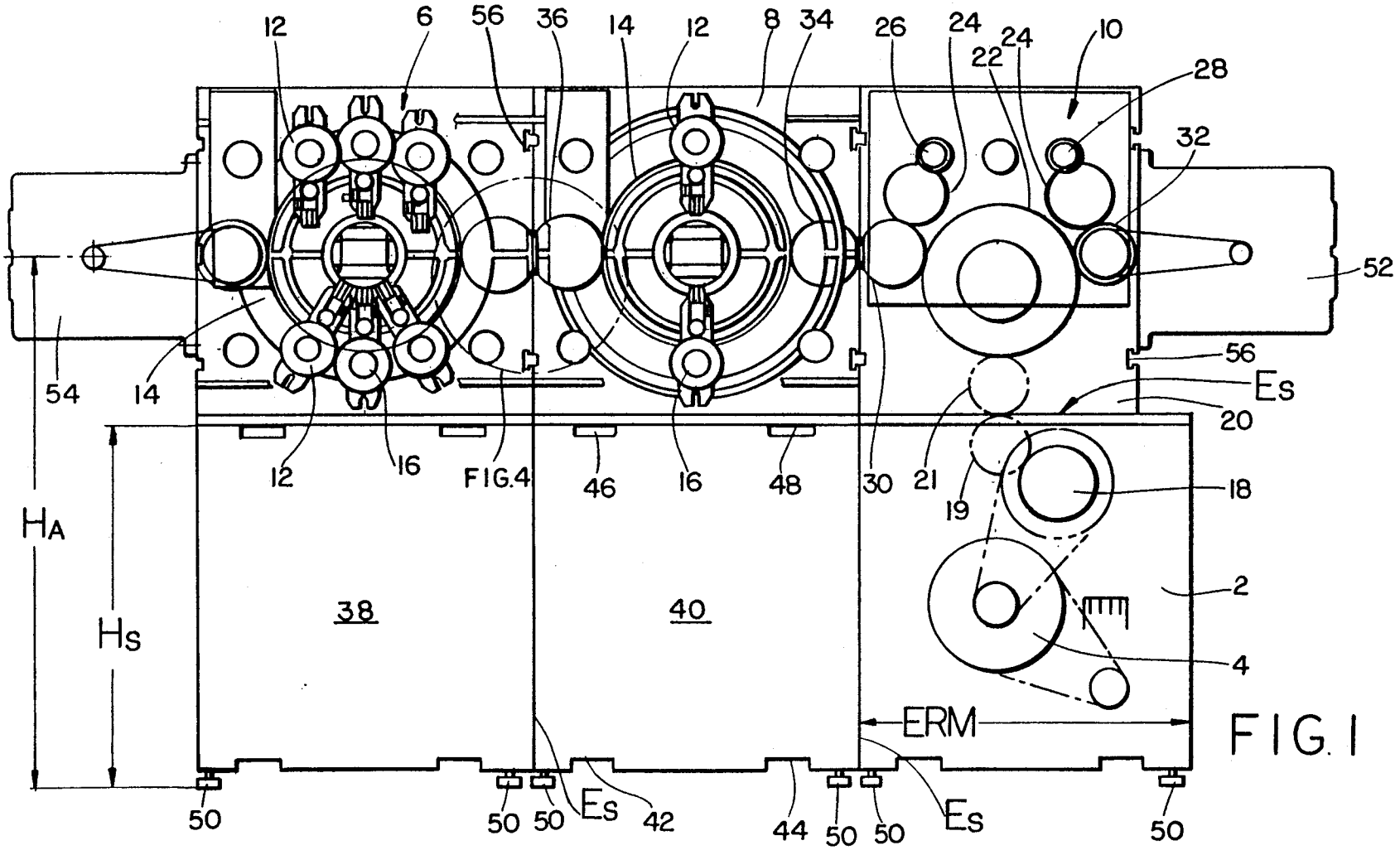
FIG. 1 shows a side view of a machining center of modular construction, according to a first embodiment form.

A base module of a drive unit forming the main drive 4 of the machining center is designated in the drawings by reference number 2. The machining center is constructed in a modular manner from three work modules 6, 8 and 10, wherein the work modules 6 and 8 function as punching/bending tool units and work module 10 is constructed as a press. Each punching/bending tool unit 6, 8 carries a plurality of tools 12 which are designed, for example, as bending carriages. Of course, other constructions are also possible, e.g. as welding stations or assembly tools.

The tools 12 are positively controlled with respect to time, i.e. they are actuated in a fixed cycle relative to one another; for which purpose, with the use of a drive with the so-called "central wheel version", a central drive rim 14 which meshes with corresponding pinions 16 of the tools is used in the shown embodiment form.

In case the tool drive is provided with the aid of a drive in the "linear version", spur gears which mesh with one another are used instead of the central drive rim as in the embodiment form according to FIG. 10, which will be described in the following.

The work modules 6, 8 do not require their own separate drive. The driving power is derived from the main drive 4 in a manner to be described in more detail in the following:

In cooperation with the base module 2 and a press housing 10 1, the main drive 4, as a placed-on machining module, is a component of a press which is constructed as a twin press in the embodiment example. For this purpose, the driving power is directed upward via a gear unit 18, indicated in a schematic manner, into the area of a press stand 20 in which a drive gear 22 is supported, the drive gear 22 being substantially centrally supported. The driving power is transmitted from the latter, via two coupling toothed wheels 30, 32 and intermediate toothed wheels 24, to the two eccentric shafts 26, 28. The drive-type connection of the adjoining work modules 6, 8 to the main drive constructed as a press is effected via the coupling toothed wheels 30, 32. The transmission of power from the motor is effected via a transmission to a transmission pinion 19 whose rolling or pitch circle is tangent to an interface plane $E_S$ between the base module 2 and the machining module 10. The transmission pinion 19 meshes with a power take-off pinion 21, the main drive gear 22 being driven via the latter 21. The meshing of pinions 19 and 21 accordingly bridges the interface plane $E_S$ between the base module 2 and the press machining module 10, so that, in connection with a gearing-type coupling with the rest of the work modules which will be described in more detail in the following, the precondition is provided for the press module 10 being removable from the module composite action in a vertical direction relative to the drawing plane of FIG. 1.

For this purpose, intermediate pinions 34, 36 are assigned to each central drive rim 14, which intermediate pinions 34, 36 can engage directly with the coupling toothed wheels. The meshing of the teeth takes place at the vertical interface planes $E_S$ between the adjacent work modules.

Since the work modules 6, 8 do not require their own drive, the housing bases 38, 40 are constructed so as to be hollow on the inside and they function as a base for the actual work units 6, 8 located above them. This offers the possibility of utilizing the housing base as transporting and positioning devices for the work units, so that the respective work unit 6, 8 can be removed together with the housing base and replaced with another unit for converting the machining center.

Two bottom recesses 42, 44 and/or two central recesses 46, 48 in which the forks of a transporting means, e.g. a fork lift, can engage, are provided at the work units 6, 8, for this purpose. Advantages result with respect to the distribution of weight particularly when the recesses 46, 48 are used, so that the transporting speed can be increased.

The view according to FIG. 1 also shows that the housing base 38, 40 and the base module 2 are constructed in a uniform grid, i.e. with the same width ERM, so that the modules can be exchanged with one another without difficulty. The modules 6, 8 further comprise a base height $H_S$ corresponding to the height of the base module 2 of the press 10. The pinions of the individual modules lie at the same axial height $H_A$ as that of the press 10. Accordingly, it is ensured by simple means that the work module to be newly coupled automatically comes to rest at the correct work height, so that the alignment of the pinions is ensured in the simplest manner. A precision level adjustment of the housing can be effected by means of adjustable support feet 50.

Figure 4:
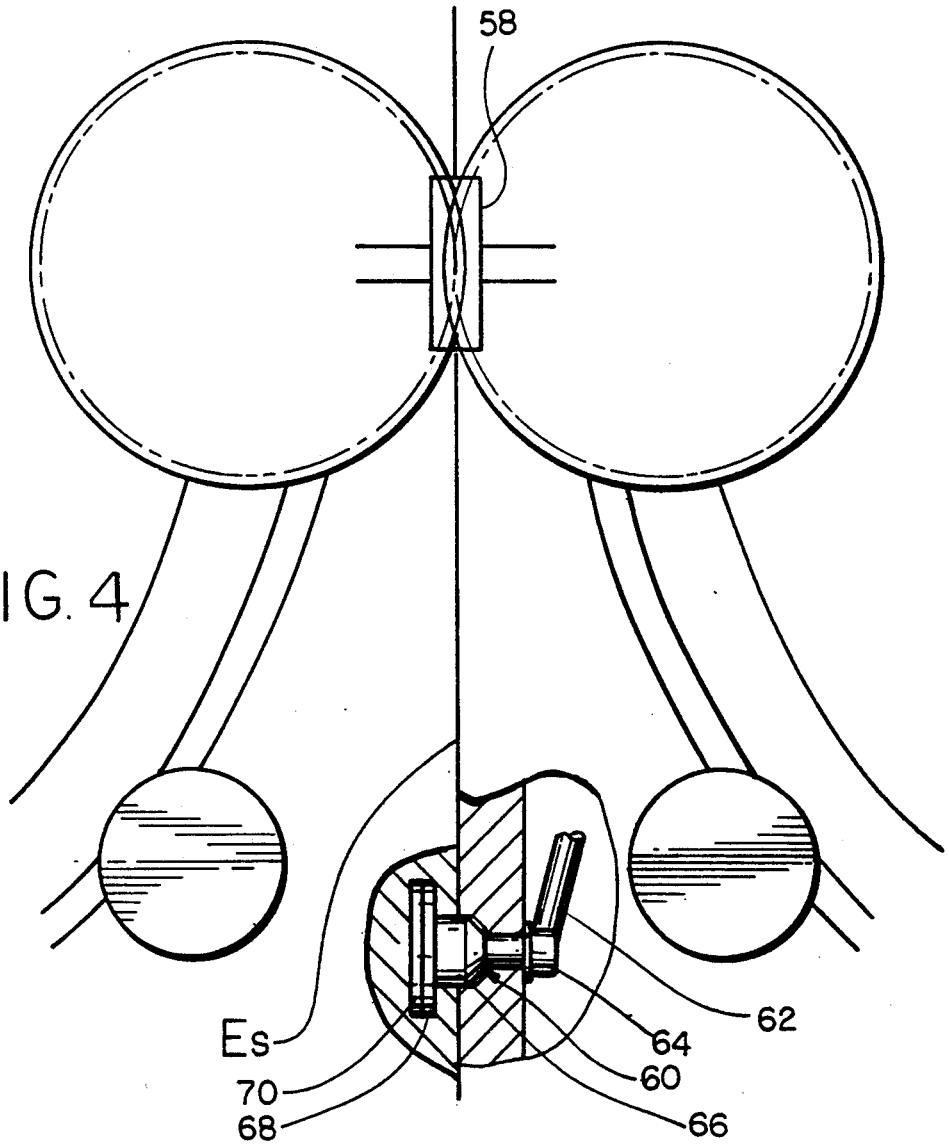
FIG. 4 shows detail "IV" in FIG. 1.

The construction of the machining center, according to the invention, still allows the possibility of connecting additional units to the work modules 6, 8 or to the press 10, respectively, e.g. front-feed devices 52, 54. Centering devices 56 in which sliding blocks can be used are preferably provided in the area of the interfaces to the adjoining units. Detail "IV" according to FIG. 4 shows for the embodiment example that the housing stands of adjacent work modules comprise recesses 58 in the area of the meshing toothed wheels, which recesses 58 are sealed during the operation of the machining center by cover plates, not shown in more detail, which can take over the function of the centering devices 56. In order to lose as little time as possible for the coupling process, it is preferable to provide in the area of the interface planes a plurality of quick-clamping locking devices 60 which can be actuated by means of a handle 62 which carries a nut 64. The nut 64 engages with a tension bolt 66 which comprises a locking plate 68 at its end, the locking plate 68 being received in an undercut groove 70 of the adjoining work module in a positive-locking manner and so as to have play.

Due to the concept of the machining center of modular construction, according to the invention, the central main drive can accordingly be placed at that point where the highest output capacity is primarily required. In addition to the advantage of favorable distribution of output, there are accordingly new, previously unusable possibilities for a flexible combination and simple exchanging of the machining, base and/or work modules, which can accordingly be equipped in addition with a central drive rim which is advantageous with respect to the power train and possibilities for the favorable arrangement of the tools.

As was already mentioned above, an automatic alignment of the reference planes results in the different machining and work modules as a result of the identical construction of all housing bases. In order to keep the feed-in plane of the semi-finished product to be machined, e.g. the wire or sheet metal strips, in exact alignment with the cutting plane 72 (see FIG. 2), a special fastening of the counter-cutting plate 74 at the press stand 20 is provided, which will be explained in more detail in the following with reference to FIGS. 2 and 5 to 7. In these Figures, corresponding structural component parts are provided with identical reference numbers, wherein the elements of the embodiment form according to FIG. 7 include an apostrophe.

The press stand 20 carries a guide part 76 at the front for the press ram 78. The guide part is constructed in a U-shaped manner and comprises two legs 80 and 82 which face downward, the counter-cutting plate 74 can be screwed directly on the legs 80 and 82. The two legs 80 and 82 end in the cutting plane 72 and the counter-cutting plate 74 closes the two legs to form a closed frame, so that there is a favorable flow of force from the cutting plate into the press stand.

Figure 6:
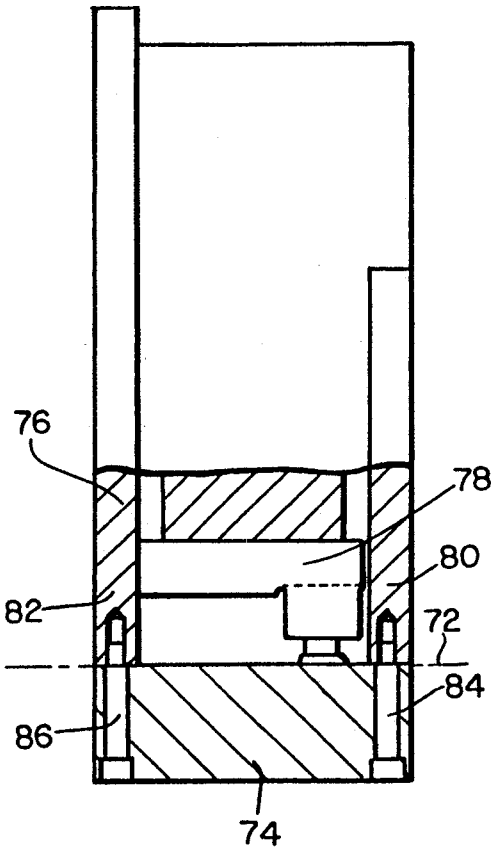
FIG. 6 shows a sectional view according to VI—VI in FIG. 5.
Figure 5:
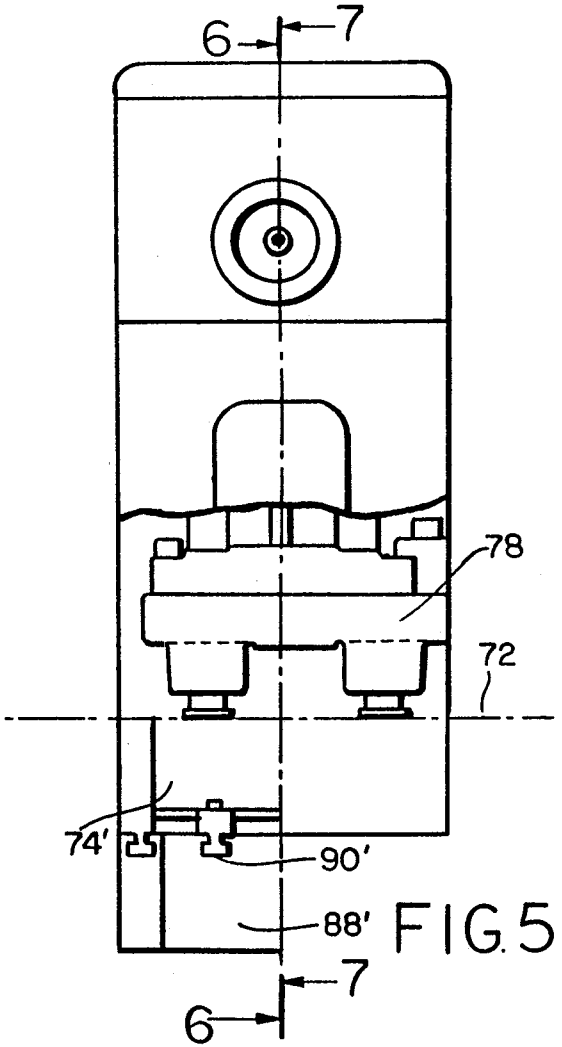
FIG. 5 shows a schematic front view of a punching unit mounted at the press in two embodiment forms.
Figure 7:
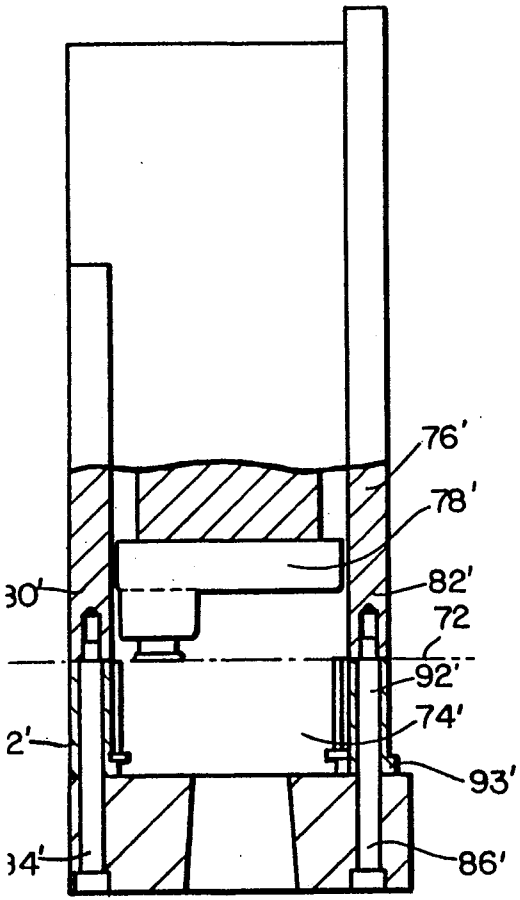
FIG. 7 shows a sectional view according to VII—VII in FIG. 5.

In the embodiment form according to FIG. 6, the counter-cutting plate 74 is screwed directly to the legs 80, 82 by means of screws 84, 86. In the event that a regrinding of the counter-cutting plate should be effected no additional steps need be taken in order to maintain the position of the cutting plane 72. The latter is permanently established by means of the lower end faces of the legs 80, 82.

The design of the guide part 76, 76' also allows the use of conventional counter-cutting plates 74' which are supported on a press bed 88' with the aid of sliding blocks 90'. In this case, the screw fastening is effected between the press bed and guide part 76' with the intermediary of spacing sleeves 92' and spacing washers 93'; when the counter-cutting plate 74' is re-machined the spacers 92', 93' must be worked down by the same extent.

Figure 2:
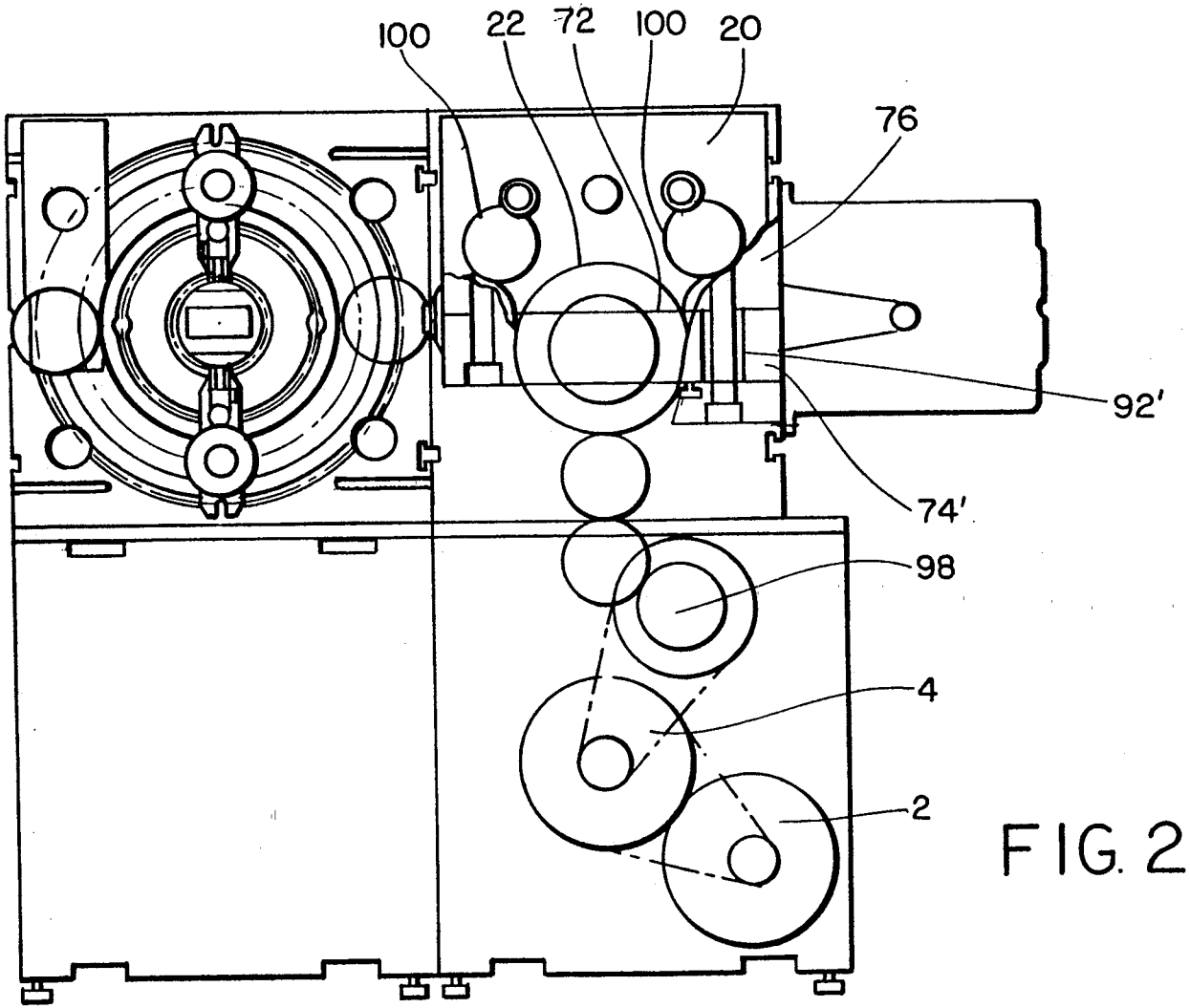
FIG. 2 shows a view of another embodiment form of the modular machining center corresponding to FIG. 1 in order to show two variants of the counter-cutting plate support at a press.

The two variants of the fastening of the counter-cutting plates 74, 74' at the press 10 are indicated in FIG. 2 with reference to a somewhat modified construction of the machining center. In other respects the modular construction of the machining center substantially corresponds to that according to FIG. 1. Here also, the driving power is transmitted from the main drive 4 to the main drive gear 22 via a gear unit 98, wherein the drive of the eccentric shafts of the press is again effected via identical intermediate toothed wheels 100 which mesh with identically toothed coupling toothed wheels, so that a synchronized drive of the tool units in the various work modules is ensured. The meshing engagement of the coupling toothed wheels is preferably likewise located in the area of the interface between the base housing 2 and the press stand 20, so that an easy connection of the two structural component parts results.

Figure 3:
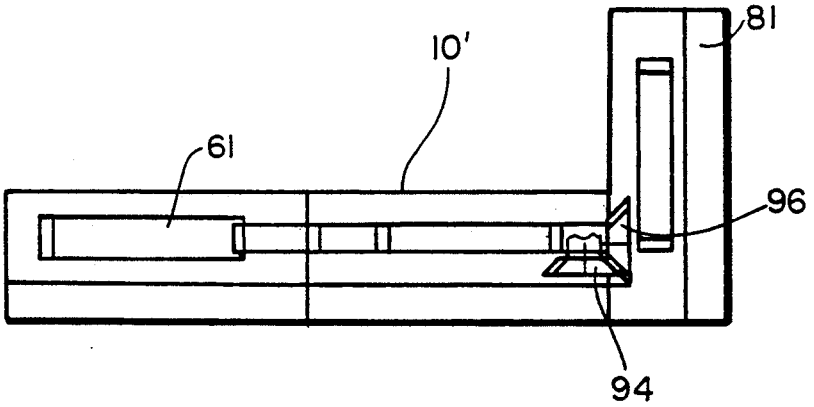
FIG. 3 shows a schematic top view of a machining center with another arrangement of the work module.

In all the embodiment forms described above the drive-type coupling of the work and machining modules with one another and with the drive base module is effected via spur gears. This coupling has the advantage that simple kinematics result for the lifting movement of the work modules when the latter are arranged in a row. In the event that the work modules are arranged at an angle, it is advantageous to effect the drive-type coupling via bevel gears 94, 96, which is indicated in FIG. 3. In this embodiment form, the press with the main drive is provided with reference number 10', the adjacent work modules are provided with reference numbers 6' and 8'.

The concept according to the invention allows the machining center to be converted in such a way that a complete work module 6, 8 is constructed at a location remote of the machining center and is exchanged if necessary by means of a crudely working transporting device, e.g. a fork lift.

Another embodiment form of the machining center constructed according to the invention is described with reference to FIG. 8. The base module receiving the central gear unit is designated by 102. It differs from the base module described above in that there are multiple possibilities in the area of the interface plane $E_S$ for coupling machining modules which are placed on top. For this purpose, two identical transmission pinions 119 and 119' are arranged next to one another, wherein it can be provided that one or the other pinion or both pinions 119, 119' simultaneously take over the power transmission to the machining module 110 located above them. The base module 102 forms a drive module with the press machining module 110 resting thereon, which drive module is constructed in turn as the drive unit of the press forming the machining center. The counter-pinion which meshes with the transmission pinions 119, 119' is indicated by 121 in the view according to FIG. 8. The relationships in this case are similar to those in the embodiment examples described above, the preceding descriptions of which should be referred to in order to avoid repetition. Recesses in the area of the meshing engagement of the toothed wheels which allow the removal of the individual components are designated by 158. These recesses are covered by covers.

In another modification of the embodiment examples described above, the coupling of the machining units 106, 108 placed on the respective bases 138, 140 is effected via a bottom or intermediate plate 107, 109, 111 which lends the machining module 106, 108 or 110 improved stability.

As in the embodiment forms of FIGS. 1 to 7, openings 146 and 148 are provided in the area of every base 138 and 140, a handling device, e.g. a fork lift, can engage in these openings 146 and 148 in order to transport the individual work modules comprising base and machining module.

Figure 8:
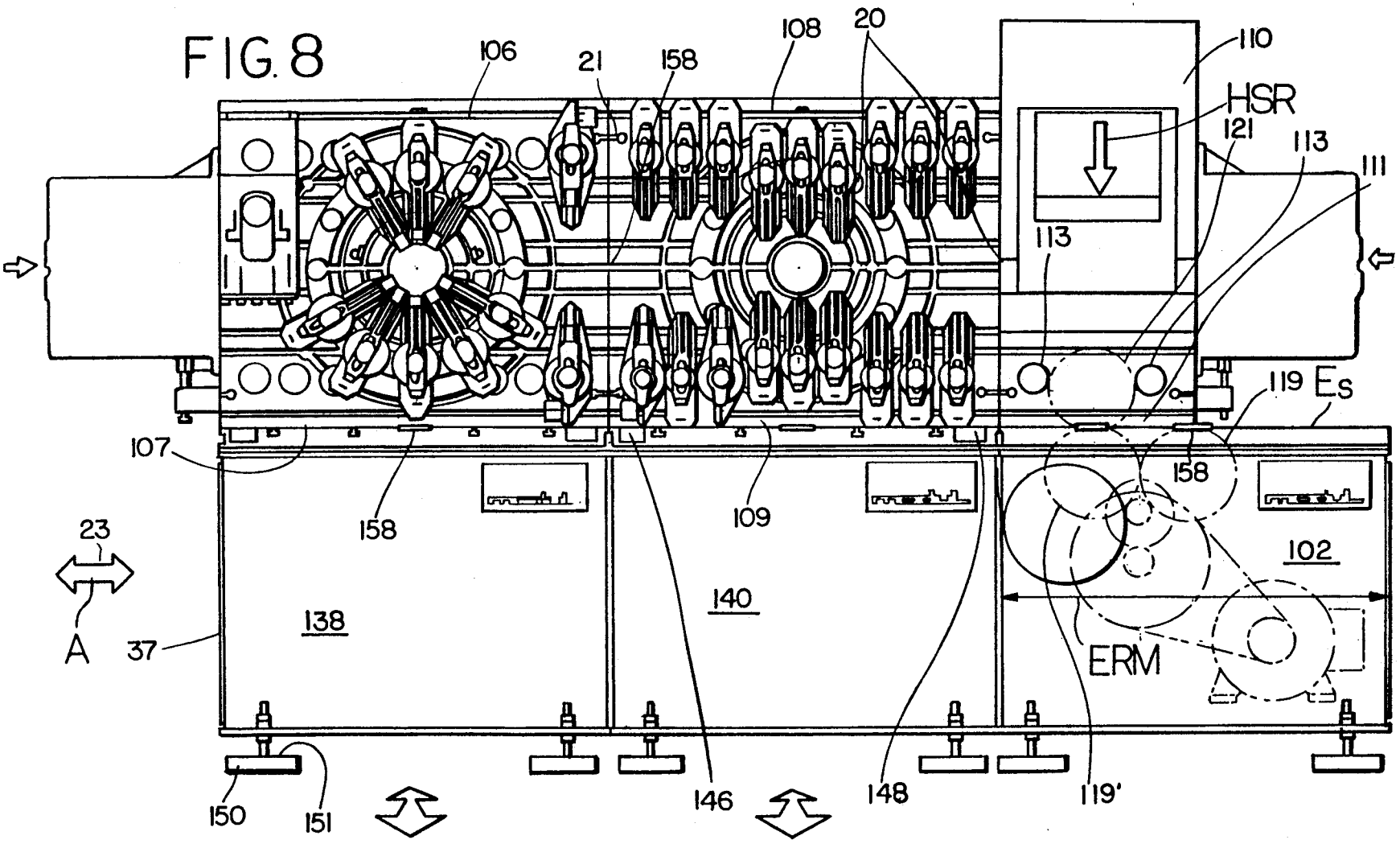
FIG. 8 shows a side view of another embodiment form of the modular machining center similar to that of FIG. 1.

In a further modification of the embodiment examples described above, the individual bases 102, 140, 138 rest on vertically adjustable feet 150, so that a gap 151 remains between the ground and the underside of the individual base housing 102, 138, 140; an extension arm of a suitable lifting unit, e.g. a fork lift, can move into this gap 151 in order to remove the base and the machining module resting on it, in its entirety, from the modular machining center in one direction which lies vertically to the drawing plane according to FIG. 8. The drive-type coupling of the work modules with one another is effected in the same manner as was described with reference to FIGS. 1 to 7. Accordingly, there is a greater flexibility with respect to the combination of the modules on the one hand and the exchangeability, wherein there is a further possibility, with respect to the edge modules 106, 138 and 102, 110, of removing the latter laterally, i.e. in the direction of arrow A.

Another particularity of the embodiment form according to FIG. 8 consists in that the press module 110 is provided at both sides of the power transmission spur gear 121 with additional drive openings 113 which serve as coupling points for the actuation of tools or slides opposite the main punching direction HSR. For example, inner teeth can be provided in which corresponding drive pinions of the slides can engage.

Figure 9:
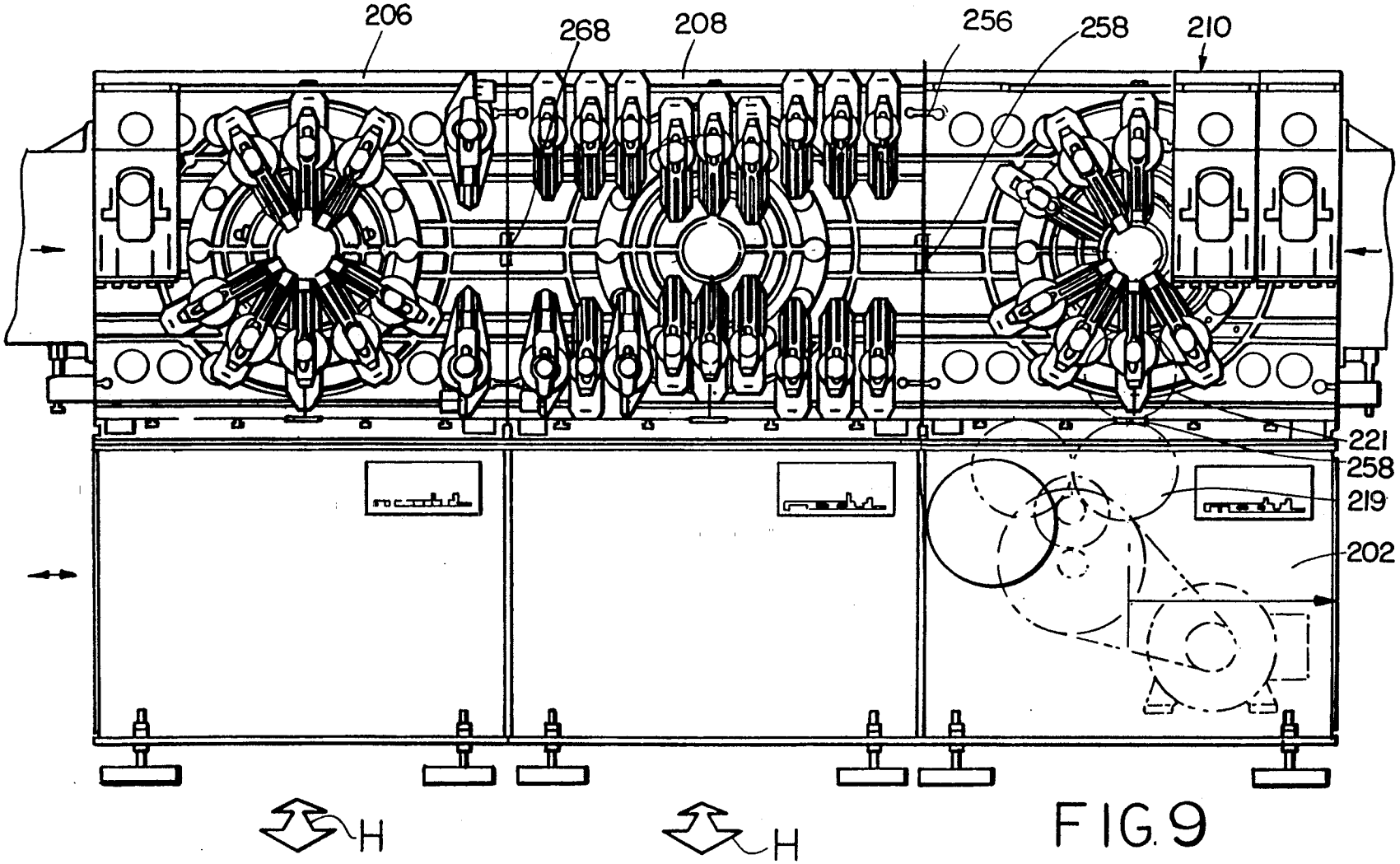
FIG. 9 shows a side view of another embodiment form of the modular machining center similar to that of FIG. 8.

The embodiment form according to FIG. 9 differs from that according to FIG. 8 only in that the base 202, which can be manipulated separately, does not carry any press housing, but rather a combined punching and bending unit 210. It can be shown with reference to this embodiment form that the separately manipulatable base module 202 is combined with that machining module 210 requiring the greatest power consumption. In this embodiment form of the drive module 202/210, the pinions 219 and 221 mesh with one another.

Beyond this, FIG. 9 shows clamping devices 256 with which adjacent machining modules 210, 208, 206 can be clamped in exact alignment with one another. The double arrow H in turn indicates that the individual work modules can be removed from the machining center in a direction which is vertical to the drawing plane according to FIG. 9 without needing to change somewhat the positional allocation of the other modules relative to one another. Recesses in the area of the toothed heads of the meshing power transmission pinions are designated by 258. As soon as the cover plate of these recesses 258 is removed, the meshing pinions can be displaced laterally relative to one another, which makes it possible to remove the respective module.

Figure 10:
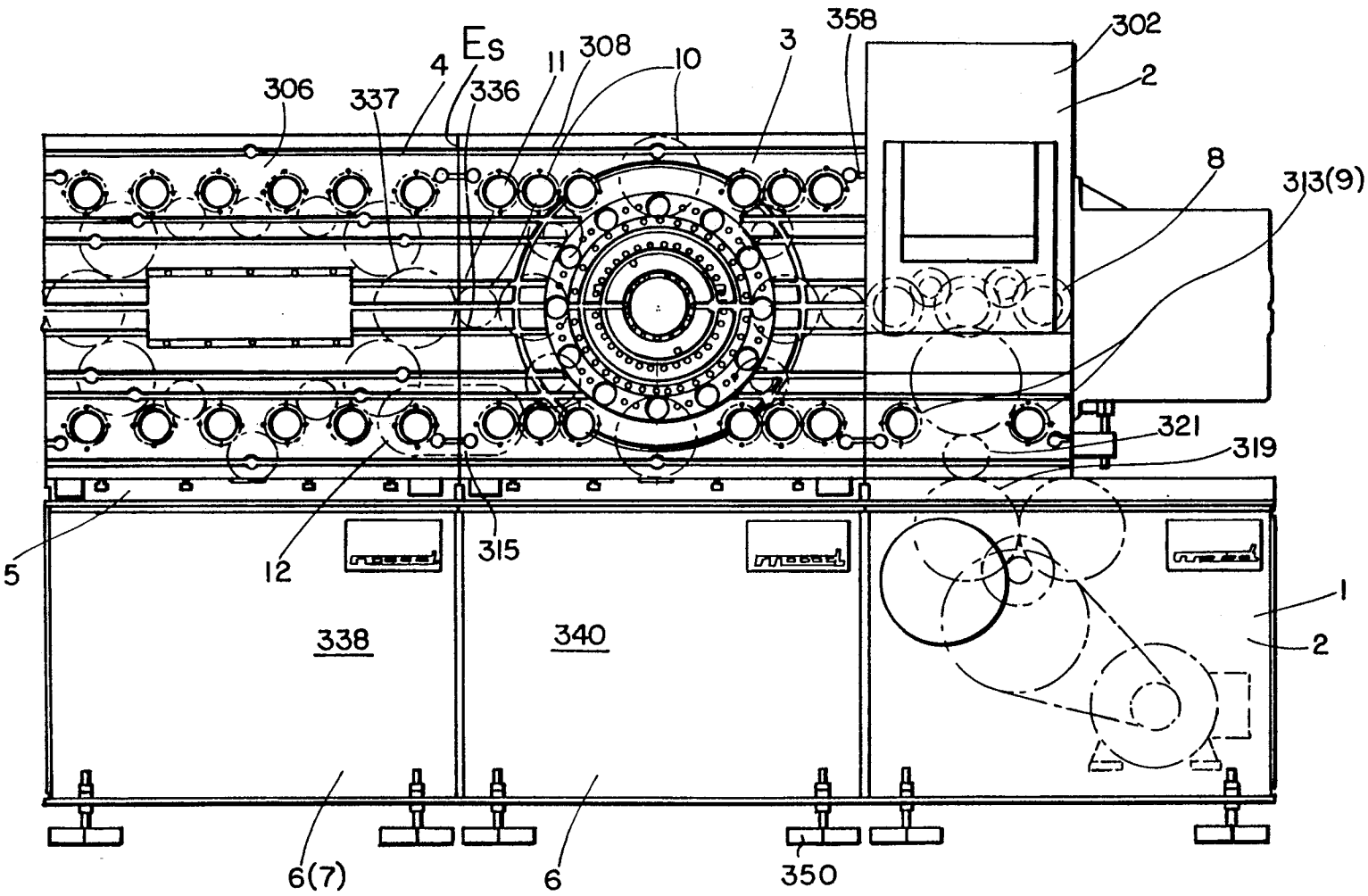
FIG. 10 shows a side view of a modification of the modular machining center shown in FIG. 9.

The embodiment form according to FIG. 10 illustrates that the concept according to the invention, upon which the construction of the machining center is based, enables the integration of machining modules 302, 306, 308 which are outfitted with different drive versions. Thus, machining module 308 is constructed in the so-called "central wheel version", while machining module 306 is constructed in the so-called "linear version". Both drive versions are coupled via the meshing toothed wheels 336, 337, wherein the respective pitch circles of these toothed wheels are tangent to the respective interface planes $E_S$. Those toothed wheels which transmit the driving power from the base module 2 to the press module 302 are designated by 319 and 321.

Also in this embodiment form the bases 338, 340 located under the machining modules 306 and 308 are constructed as empty bases. However, it should be stressed already at this point that it is of course possible to provide these bases with an auxiliary additional drive having only a pushing function. The synchronous operation of the individual work stations is achieved, as was the case before, via the coupling toothed wheels which mesh with one another and which bridge the respective interface planes $E_S$.

FIG. 10 further shows that other possibilities for a drive and power take-off branching can of course be provided in the area of the machining modules. It is possible to flange mount-on gear units to the individual machining modules in order to assign an additional, reinforcing drive to one or the other machining module. For this purpose, a drive branching located in the lower area of the individual machining modules 306, 308 and 302 is designated by reference number 313 in the embodiment form according to FIG. 10. A branching gear unit 315 by means of which a rotary force can be transmitted to the individual drive branches 313 is shown in dash-dot lines.

For the rest, the construction of the modular machining center corresponds to that of the embodiment examples described in the preceding, so that a more detailed discussion of the illustrated components would not appear necessary.

It was already mentioned in the preceding that the respective machining module 2, 6 and 8 rests on the respective base via an intermediate plate 107, 109 and 111. This can be seen particularly from FIG. 11 which shows a side view of an individual work module. In this embodiment form, the base is designated by 440, the respective intermediate plate is designated by 409 and the machining module is designated by 408. It can be seen that the intermediate plate 409 has a considerable depth in order to provide the machining module 408 with good stability. Moreover, the intermediate plate 409 simultaneously serves as transporting and fastening element for the machining module 408, as well as centering element for the exchange process to be described later.

Figure 11:
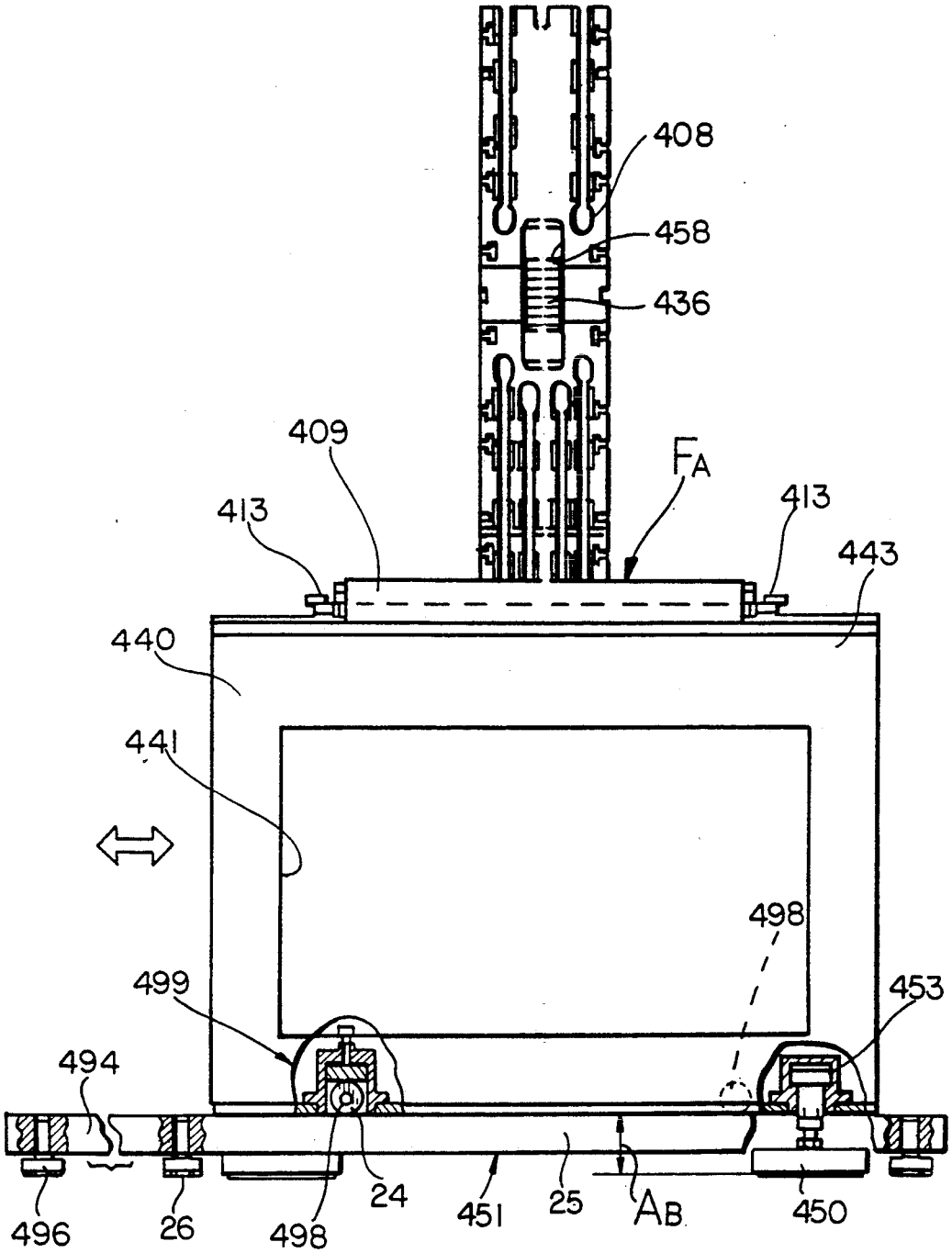
FIG. 11 shows a side view of a work module removed from the machining center, with a first embodiment form of a quick-change device.

The view according to FIG. 11 further shows that the base 440—which is a center work module which does not comprise its own drive—is constructed as an empty base. An opening in the side wall 443 is designated by 441, so that the bases which are arranged in rows can be connected to one another. It is accordingly possible to accommodate the cables required for the control of the individual units, as well as other control devices, in the machining center in a simple manner, i.e. to wire the individual control units along the shortest distances.

In an advantageous manner, the intermediate plate 409 is made use of for controlling the respective machining module 408. This intermediate plate 409 comprises plug-in connection devices 413 at its front and rear end faces for respective control connections, control ducts—not shown in more detail—which are guided toward the connection surface $F_A$ to the machining module 408 open into the latter 413.

The power transmission toothed wheel which is designated by 436 and projects from the recess 458 with the respective toothed head—see FIG. 4—can be seen from the view according to FIG. 11.

A first embodiment form of a quick-change device for the complete work module comprising base 440 and machining module 408 will be described in the following with reference to FIG. 11:

The quick-change device comprises a pair of rails 494 which are supported on the ground via vertically adjustable feet 496 which are arranged at predetermined longitudinal intervals from one another. It is possible to level the rails 494 because of the vertical adjustability of the feet 496, so that an exact rail course can be provided even when the floor of the workplace is undulating. The rails 494 are slid into the floor clearance space 451, described above, between the base 440 and floor so as to be in parallel alignment with one another. For this purpose, either the base is lifted slightly beforehand or the rails 494 are offset slightly in an upward direction after positioning below the base 440. For this purpose, hydraulic actuating devices can be provided for the vertically adjustable feet 496 which are preferably actuable centrally.

A further possibility for bringing the rails 494 into a functional engagement with running wheels 498 in the front and rear lateral area of the base 440 is indicated with reference to FIG. 11. For this purpose, the supporting feet, designated by 450, cooperate with a piston-cylinder arrangement 453, so that the base distance $A_B$ before the insertion of the rails 494 can temporarily be increased slightly. The base 440 with the machining module 408 resting upon it can be lowered on the rails 494 by means of renewed actuation of the piston-cylinder unit 453, so that the running rollers 494 which are likewise supported at the base 440, preferably so as to be vertically adjustable—as indicated at 499—gradually come into running contact with the rail surface 494. The base 440 is now movable on the leveled rails 494, according to FIG. 11, in the direction of the arrow, i.e. it can be moved out of the connection of individual modules forming the machining center. The rails 494 can perform a guiding function for the base movement. Of course, the movement is additionally stabilized in an advantageous manner in that guides which are to be described in more detail in the following remain held at the sides of the intermediate plate 409 in functional engagement with the adjacent intermediate plate of the adjacent work module. Of course, the clamping device described with reference to FIG. 4 must be disengaged before the removal of the individual base 440 with respective machining module 408.

In order to facilitate the exchange of the entire work module, it is advantageous to keep the width of the base slightly smaller than the width of the machining module resting on top of it.

Figure 12:
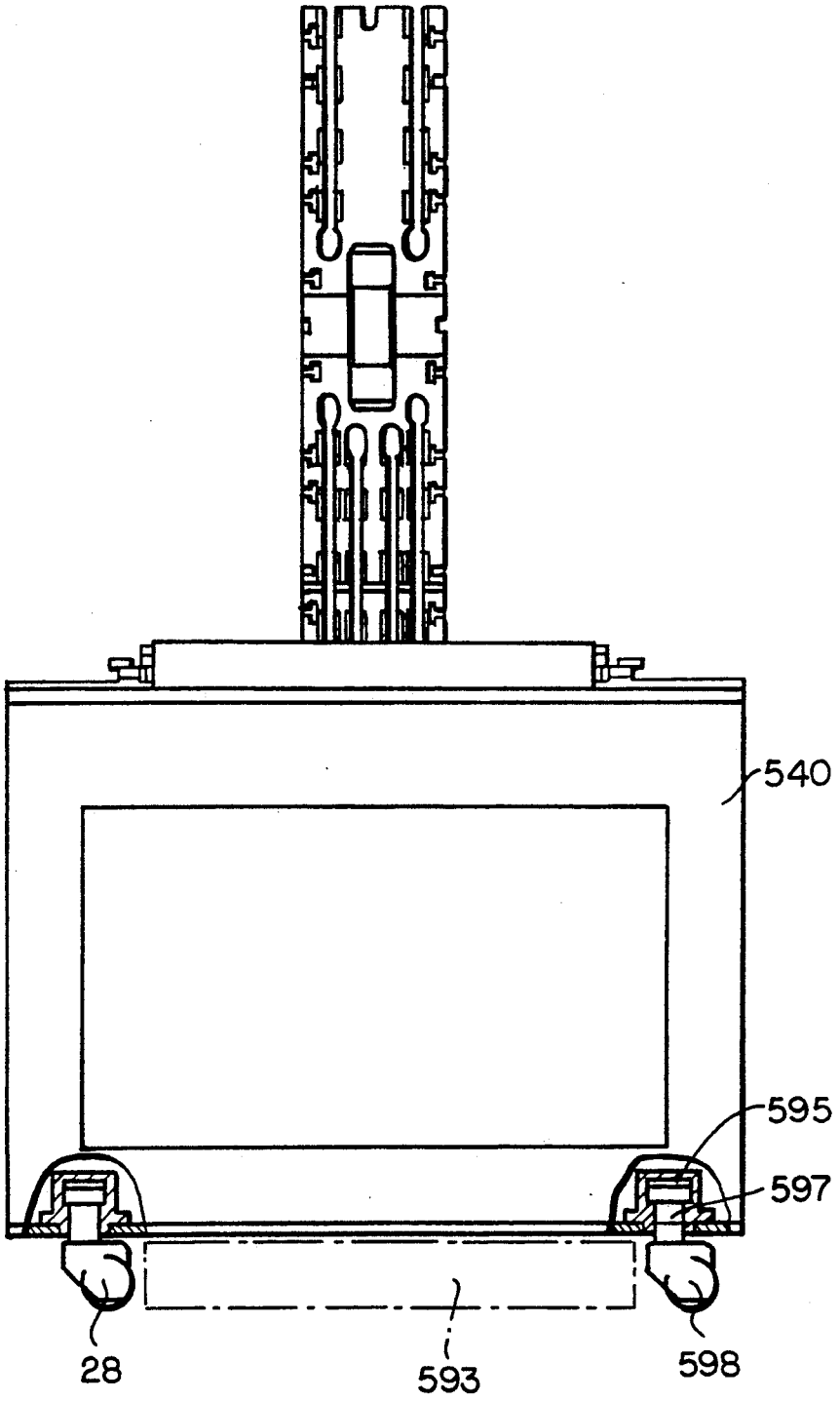
FIG. 12 shows a view similar to FIG. 11 in order to show another embodiment form of an auxiliary device for quickly changing the work module.

The embodiment form according to FIG. 12 differs from that according to FIG. 11 only in that the base 540 is constructed so as to be self-drivable. For this purpose, swiveling rollers 598 which can preferably be advanced, i.e. are adjustable in height, are provided in the lateral front and rear area of the base 540. The swivel axles 597 cooperate with a pressure medium cylinder 595, so that the clearance between the base 540 and the ground can be increased slightly for transporting purposes. In this state, a support body 593, indicated in FIG. 12 in dash-dot lines, on which the base 540 rests in a fixed manner in the installed state, can be removed, whereupon the exchange is made possible at both sides.

Figure 13:
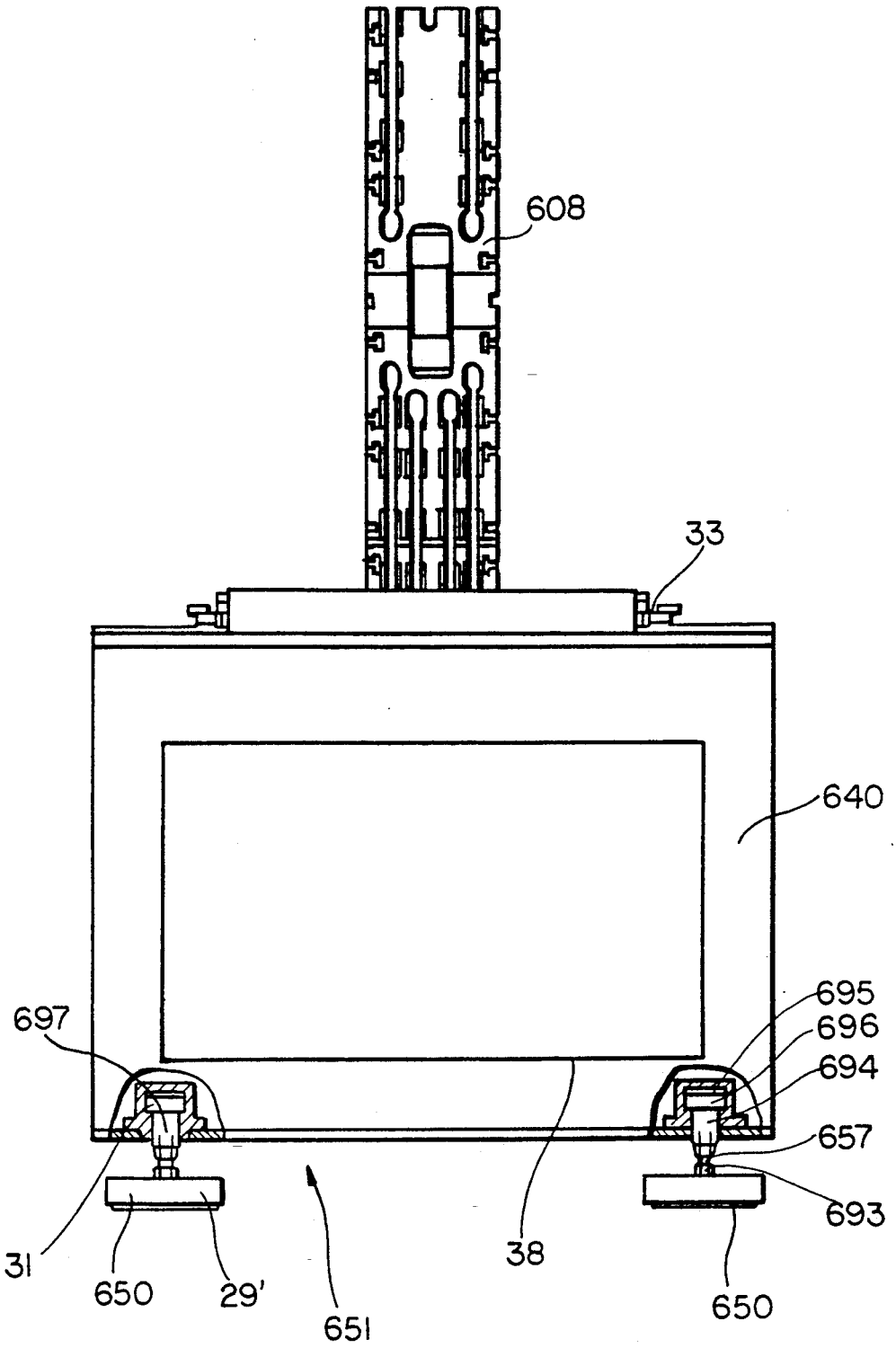
FIG. 13 shows a side view of another embodiment form of a work module of the machining center of modular construction according to the invention.

A variant of a leveling device for the work modules comprising base 640 and machining module 608 is described in more detail with reference to FIG. 13. Support feet at the corners of the respective base 640 are designated by 650. The shaft, designated by 657, is longitudinally adjustable in that a spindle portion is screwed into an internal thread of a piston 694 and clamped by means of a lock nut 693. The piston 694 projects into a cylinder 695 which can be acted upon by hydraulic fluid. An eccentric cam device can be used for building up the hydraulic pressure in the cylinder space 695. When pressure is built up, the piston step 696 strikes against the base 697 of the cylinder so that the preadjusted distance from the floor is predetermined. In the state in which the piston-cylinder arrangement shown in FIG. 13 is acted upon, a fork lift can be driven into the free space 651 below the base 640, whereupon the cylinder space 695 is relieved again and the entire work module 608, 640 is lowered onto the fork lift.

Figure 15:
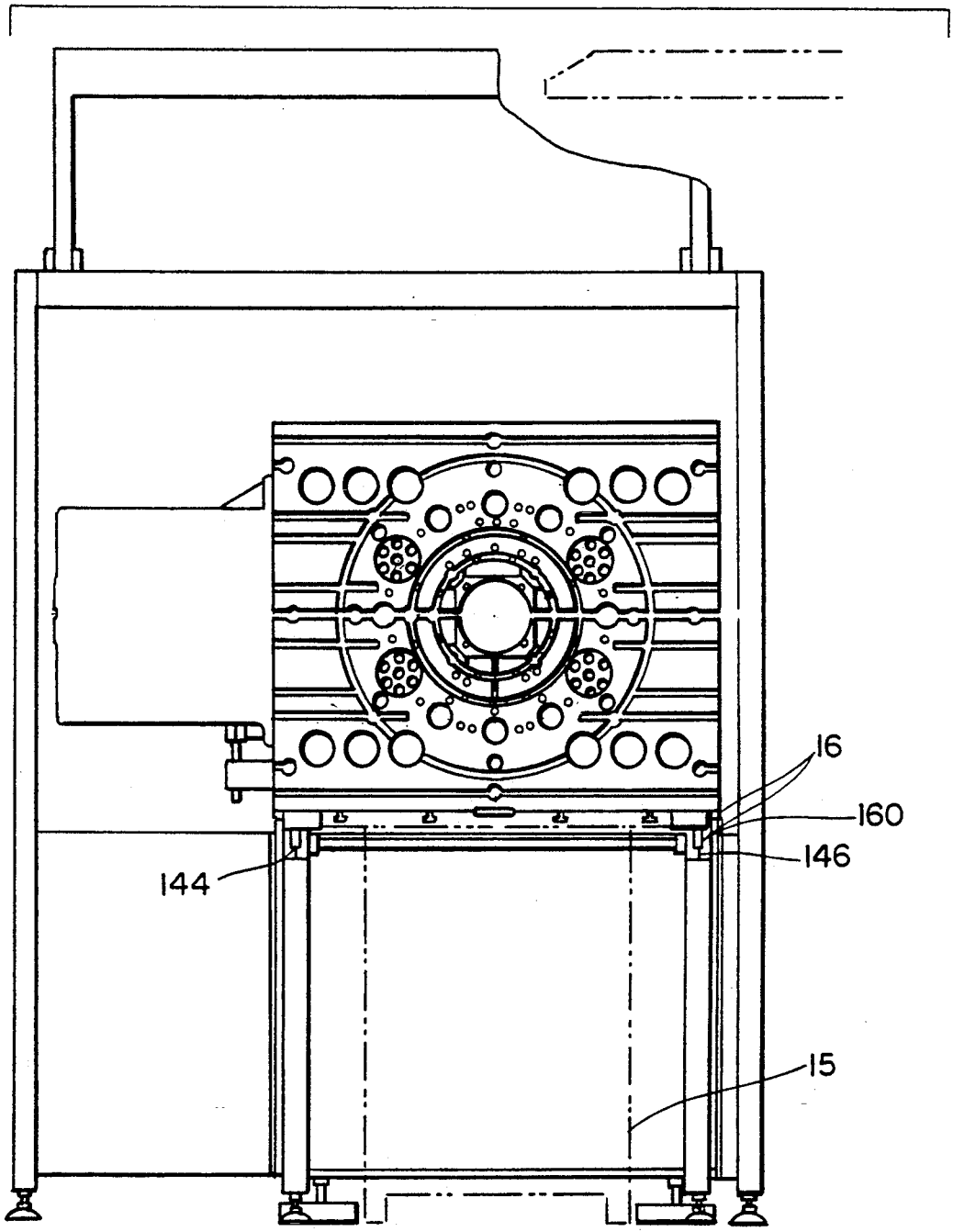
FIG. 15 shows the view according to "XV" in FIG. 14.

An embodiment form of a quick-change device for exchanging the individual machining modules is described in more detail in the following with reference to FIGS. 14 to 18:

The quick-change device comprises a roll-out stand 140 with columns and struts, wherein the columns 142 rest on the vertically adjustable feet 144. The stand carries two rails 144, 146 at its upper side which are at a distance from one another laterally and are movable until their front sides abut against the respective base of the machining module to be exchanged, so that a cantilevering end portion 148 can be brought into the area of a guide portion of the intermediate plate 709, which guide portion is not shown in more detail. In this manner, the cantilevering portion 148 forms a pre-centering device for the exchange process. In addition, precision centering devices can be provided at the roll-out stand—as indicated in FIG. 15 by 160—in order to exclude from the outset any tilting of the machining module to be exchanged caused by transporting.

A plurality of running rollers 145 are supported in the side cheeks of the guide rails 144 and project slightly from the surface of the guide rails 144, 146.

Figure 16:
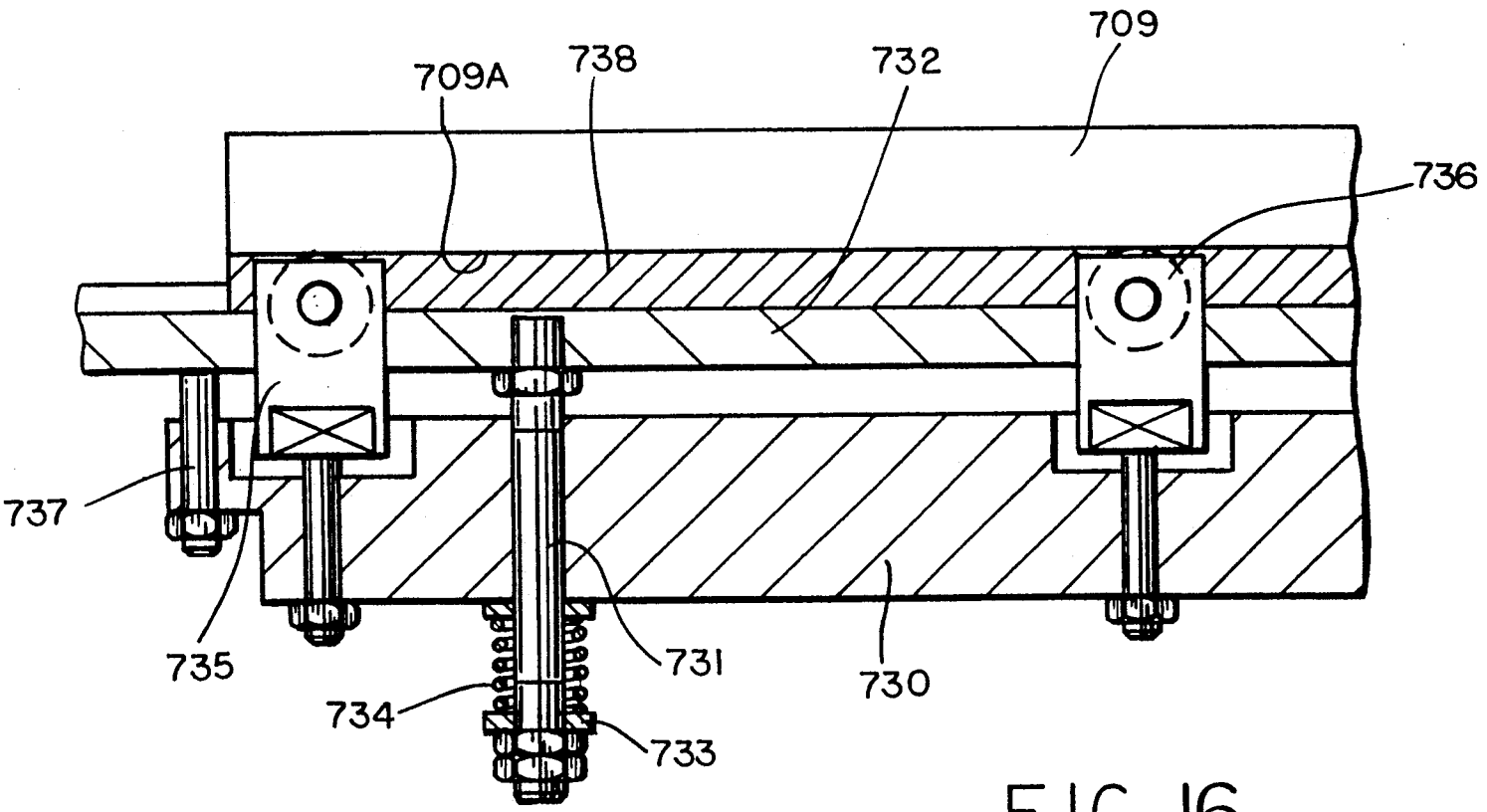
FIG. 16 shows detail "XVI" in FIG. 14.

A cross-piece 730 is supported in the base 740 as can be seen in particular from FIG. 16. The cross-piece is penetrated by a plurality of bolts 731 which are screwed together with a cover plate 732 of the base 740 at one end and carry a plate washer 733 at their other end, a pressure spring 734 which acts on the underside of the cross-piece 730 being supported at the plate washer 734.

The cross-piece 730 carries a plurality of bearing forks 735 for the rotatable support of running rollers 736. The lift of the cross-piece 730 which is initiated by the spring 734 is defined by means of adjustable pins 737.

A sliding plate 738 is screwed onto the cover plate 732. In the assembled state of the machining module, the intermediate plate 709 is securely screwed together with the cover plate 732, so that the individual running rollers 736 are pressed downward against the force of the springs 734 via a guide surface 709A of the intermediate plate 709.

When the machining module is to be exchanged, the fastening screws for the intermediate plate 709, which are not shown in more detail, are loosened. In this way, the machining module floats, as it were, in that it is moved upward by the springs 734 with such great force that the sliding contact between the plate 738 and the guide portion is canceled in a way. When the rollout stand is moved in, the machining module to be exchanged can be moved out of the machining center after loosening the clamping devices between the individual machining modules. The arrangement is executed in such a way that the intermediate plate 709 on each side always lies on at least two rollers. Accordingly, as soon as the trailing edge of the intermediate plate 709 leaves the central running roller 736, the leading end of the intermediate plate 709 comes into rolling contact with the foremost running roller 145 of the roll-out stand 140, so that a smooth and easy-going movement of the machining module to be exchanged is achieved.

Figure 14:
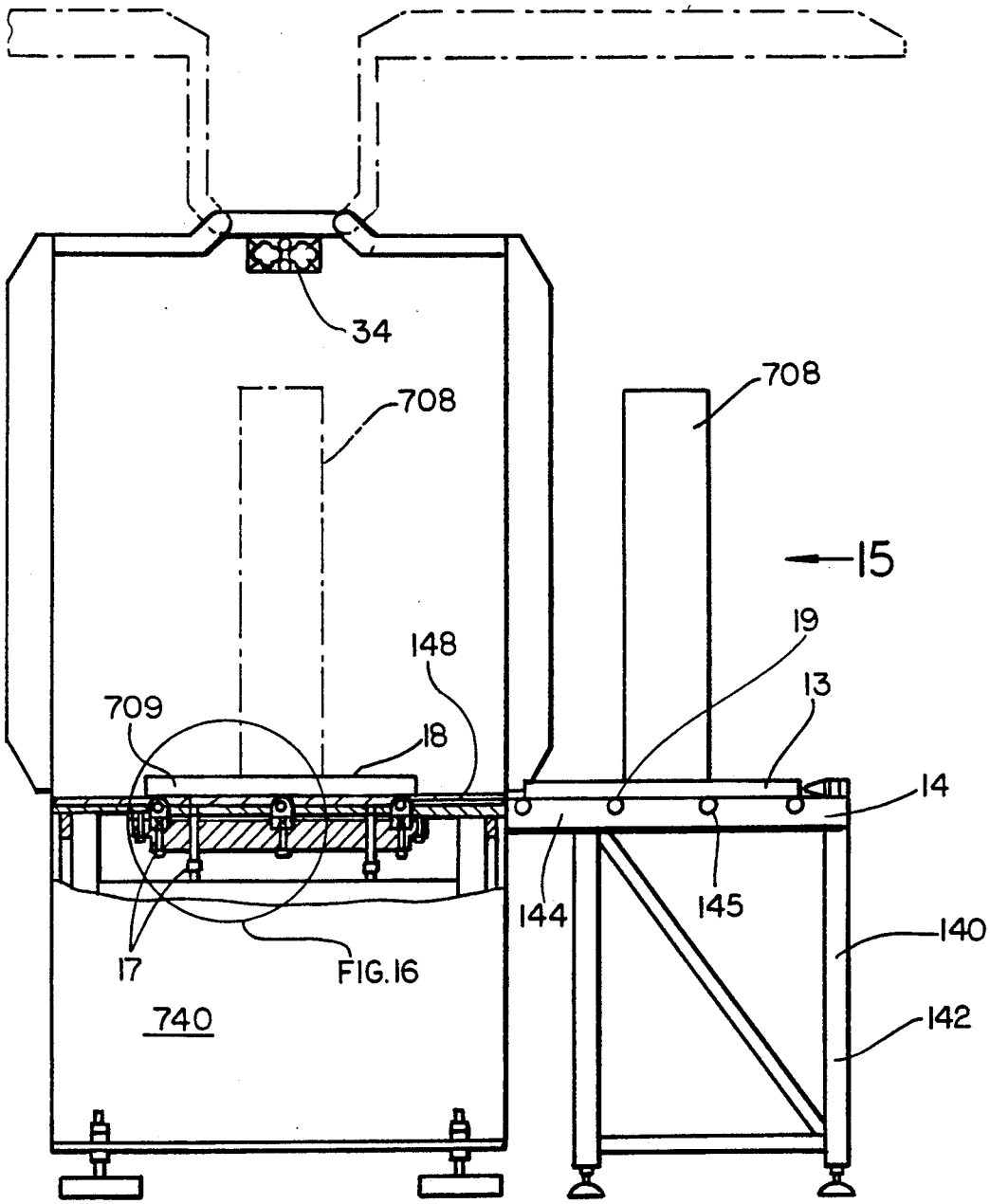
FIG. 14 shows a side view of a work module, shown partially in section, in cooperation with a quick-change device for the machining module.

Of course, the safety covering indicated in dash-dot lines in FIG. 14 is to be folded away before the exchange of the individual machining modules.

Figure 17:
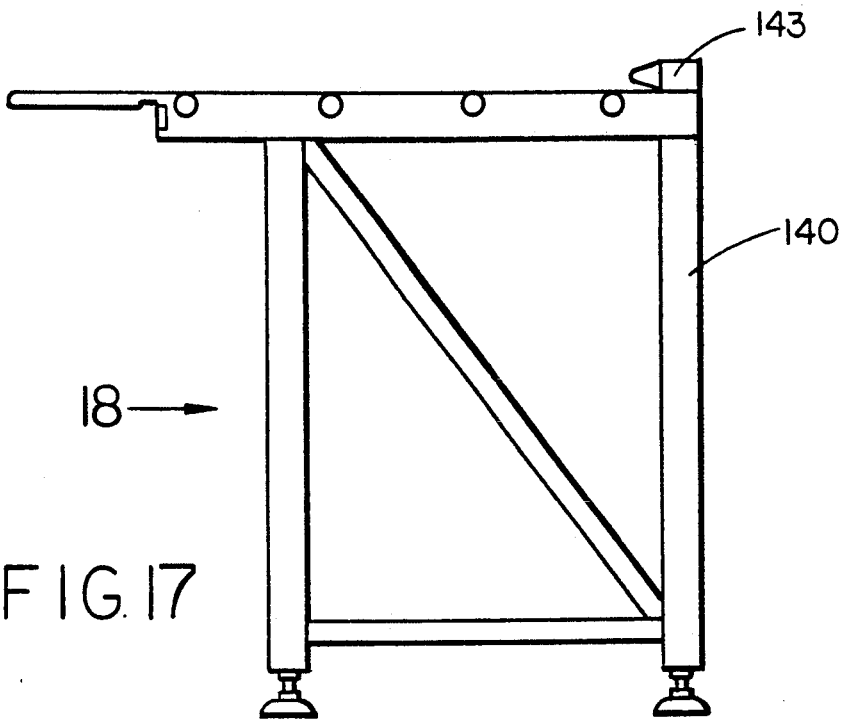
FIG. 17 shows a side view of a roll-out stand employed in the quick-change device according to FIG. 14.
Figure 18:
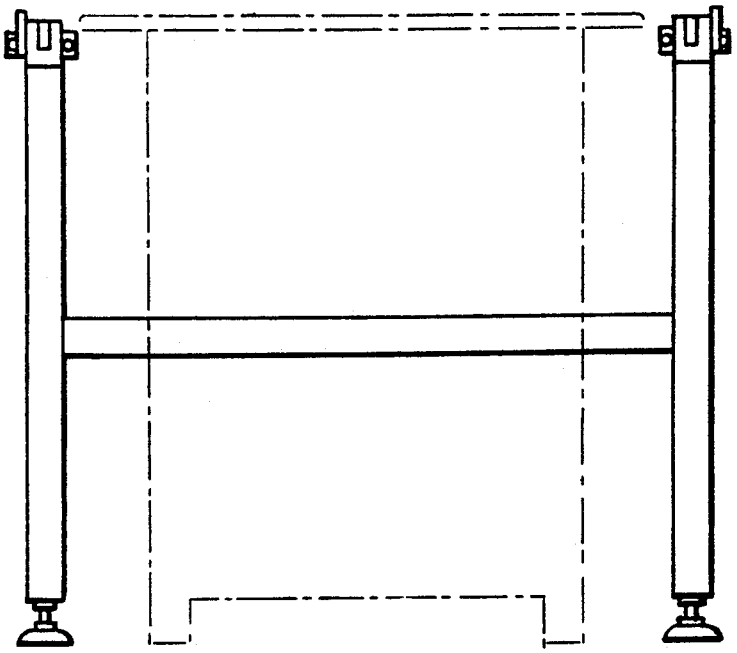
FIG. 18 shows the view of the roll-out stand corresponding to "XVIII" in FIG. 17.

Details of the roll-out stand 140 are shown in FIGS. 17 and 18. This view shows that a centering device 143 is provided at the rear end of the roll-out stand, by means of which the pulled out machining module can be positioned on the stand 140. When the machining module is completely pulled out, the roll-out stand 140 can be grasped by means of suitable conveying means, e.g. by means of a fork lift, and the machining module can be transported to an intermediate storage location.

Finally, an alternative construction of the quick-change device is indicated in dash-dot lines in FIG. 18. In this instance, a conventional lifting car carries a transporting plate at top, the machining module to be exchanged can be slid onto this transporting plate.

It is accordingly clear from the preceding description that drive modules which consist of a base module which receives the main drive and a machining module which rests on it and are optimally adapted to individual requirements can be combined by means of the steps according to the invention. This drive module can be used as a self-sufficient unit or in combination with other work modules to form a machining center, wherein, as a result of its unit modular width which is adapted to the rest of the work modules, it is possible to arrange the drive module at any desired location in the machining center and—if necessary—to exchange it for another, already prepared drive module in the course of converting the machining center.

Accordingly, a machining center of modular construction is described which comprises various work modules which are driven by a drive unit and comprise tools which are positively controlled laterally, e.g. bending tools, front-feed devices, welding stations, assembly units or the like. The drive unit is constructed as a base module which can be handled separately and comprises the main drive for the machining center and has a width corresponding to a unit modular dimension of the work modules integrated into the machining center. The transmission of power from the main drive to the individual work modules is effected via toothed wheels which mesh with one another and bridge the respective interface planes between the base module and the outfitted work module placed on it on the one hand and between the adjacent work modules on the other hand. This results in a space-saving and economical integration of the drive unit into the machining center.

I claim:

1. A modular machining center comprising:

a main base module having a first width;

a first machining module mounted on said main base module;

a drive unit positioned within said main base module;

a work module comprising:

a tool base module having a width corresponding to said first width, a second machining module comprising a time controlled tool, said tool being mounted to said tool base module and being selected from the group consisting of bending tools, front-feed devices, welding stations, and assembly units, an intermediate transmission having a power-receiving gear and a powertransferring gear, said work module being positioned adjacent to said main base module to form an interface plane, said power-receiving gear being positioned to mesh at said interface plane; and a main transmission for transferring power from the drive to an adjacent work module, said transmission including a toothed wheel which engages said power-receiving gear of said adjacent work module at said interface plane.

2. The machining center according to claim 1, wherein the machining module forms a press housing.

3. The machining center according to claim 2, wherein said main transmission is provided in the press housing.

4. The machining center according to claim 3, wherein said main transmission includes a substantially centrally supported main drive gear which effects the drive on adjacent work modules via intermediate gears.

5. The machining center according to claim 3 or 4, wherein the press housing carries a press stand, a downwardly open, U-shaped guide part for the press rams being fastened to the press stand, a countercutting plate being screwed directly to the downwardly directed legs of the press rams.

6. The machining center according to claim 1, wherein said main base module and said tool base module are equipped with openings for the engagement of a fork lift.

7. The machining center according to claim 1, wherein the work module comprises locking devices with which a zero setting of the tools can be fixed relative to one another.

8. The machining center according to claim 1, wherein the powerreceiving gear, the power-transferring gear and the toothed wheel are straight-toothed spur gears and the disengaging direction of the modules is aligned parallel to the interface plane.

9. The machining center according to claim 1, wherein an intermediate plate is arranged between the base module and the machining module.

10. The machining center according to claim 1, wherein the tool base module is slightly narrower than the tool resting on the tool base module.

11. The machining center according to claim 1, wherein the tool base modules are connected with one another by means of lateral openings.

12. The machining center according to claim 1, wherein the tool base modules stand on leveling elements including means for adjusting the height of the leveling elements.

13. The machining center according to claim 12, wherein the leveling elements are engaged and locked by hydraulically working clamping devices.

14. The machining center according to claim 12, wherein the leveling elements are formed from rolls which are swivelable and include hydraulic adjustment means.

15. The machining center according to claim 1, wherein quick-locking clamping devices are provided to overlap the interface plane between the base modules.

16. The machining center according to claim 1 including a quick-change device for exchanging the drive-base module and the work modules.

17. The machining center according to claim 16, wherein the quick-change device comprises a rail pair slidable under the base modules which carry at least two running rollers on each side, the running rollers being aligned with the rails, and contacting the rails for the purpose of transporting.

18. The machining center according to claim 17, wherein the rails are supported at the floor via a plurality of adjusting elements which are adjustable with respect to height.

19. The machining center according to claim 17, wherein the running rollers include means for adjusting height of said running rollers.

20. The machining center according to claim 1, wherein guide elements are provided adjacent to an area of the interface between the tool base module and machining module, said guide elements engaging guide elements of adjacent modules.

21. Machining center according to claim 20, wherein the guide elements are constructed as an intermediate plate between the base and the machining module.

22. The machining center according to claim 1, including a quick-change device for exchanging the machining modules.

23. The machining center according to claim 22, wherein a roll-out stand is provided which comprises two guide rails running parallel at a lateral distance from one another, the guide rails having cantilevering end portions which can be brought up to a base plate of the module to be exchanged laterally in such a way that the upper edge of the rails is aligned with the lower edge of the guide area of the base plate.

24. The machining center according to claim 23, wherein the guide rails carry a plurality of running rollers which project a short distance from the upper edge of the rails.

25. The machining center according to claim 23 or 24, wherein at least two running rollers which are spaced longitudinally and are supported at the base via a spring device are mounted in the base on each side below the respective guide area.

26. The machining center according to claim 25, wherein the running rollers of one side are held by a carrier element which is supported at a spring assembly so as to be guided in the vertical direction.

27. The machining center according to claim 26, wherein the carrier element is penetrated by holding bolts which are screwed together with the base so as to be suspended and carry a nut at one end at which a supporting spring is supported.

28. A drive module, particularly for a machining center, comprising a base module adapted for separate handling and which further comprises the main drive for a machining center of modular construction, a machining module including a press, bending module, placed on the base module, wherein the transmission of power from the base module to the machining module is effected via toothed wheels which mesh with one another, wherein the meshing engagement lies in the area of the interface plane between the base module and machining module.

29. A drive module according to claim 28, wherein a plurality of power take-off toothed wheels are supported in the base module, a rolling or pitch circle of the power take-off toothed wheels being tangent to the interface plane and transmission of power into the machining module being effected by means of the power take-off toothed wheels.

30. The drive module according to claim 28 or 29, wherein the machining module is formed as a press module having a main punching direction and at least one drive opening for a coupling point for actuating the tools and slides opposite the main punching direction is provided at both sides of a toothed wheel which effects the transmission of power from the base module to the press and is supported in the press module.

31. Drive module according to claim 30, said at least one drive opening is provided with an inner toothing.

32. Machining center according to claim 3, wherein the press housing carries a press stand at which a downwardly open, U-shaped guide part for the press ram is fastened, a press bed being fastened to the press rams by spacing sleeves.

33. Machining center according to claim 4, wherein the press housing carries a press stand at which ah downwardly open, U-shaped guide part for the press ram is fastened, a press bed being fastened to the press rams by spacing sleeves.

* * * * *